US012753538B2

(12) United States Patent
Baggio et al.

(10) Patent No.: US 12,753,538 B2
(45) Date of Patent: Oct. 6, 2026

(54) FABRIC AND METHOD FOR OBTAINING SAID FABRIC

(71) Applicant: SIRETESSILE S.R.L., Cornuda (IT)

(72) Inventors: Alessandro Baggio, Asolo (IT); Marco Lucchese, Villorba (IT)

(73) Assignee: SIRETESSILE S.R.L., Cornuda (IT)

( * ) Notice: Subject to any disclaimer, the term of this patent is extended or adjusted under 35 U.S.C. 154(b) by 95 days.

(21) Appl. No.: 18/687,311

(22) PCT Filed: Sep. 1, 2022

(86) PCT No.: PCT/IB2022/058222
§ 371 (c)(1),
(2) Date: Feb. 28, 2024

(87) PCT Pub. No.: WO2023/031850
PCT Pub. Date: Mar. 9, 2023

(65) Prior Publication Data

US 2024/0352637 A1 Oct. 24, 2024

(30) Foreign Application Priority Data

Sep. 3, 2021 (IT) ..... 102021000022883

(51) Int. Cl.

| | |
|---|---|
| ***D06C 27/00*** | (2006.01) |
| ***D03D 13/00*** | (2006.01) |
| ***D03D 15/217*** | (2021.01) |
| ***D03D 15/283*** | (2021.01) |
| ***D03D 15/47*** | (2021.01) |
| ***D03D 47/30*** | (2006.01) |
| ***D06C 15/02*** | (2006.01) |
| ***D06L 1/12*** | (2006.01) |
| ***D06L 4/13*** | (2017.01) |
| ***D06L 4/60*** | (2017.01) |
| ***D06M 10/00*** | (2006.01) |
| ***D06M 101/06*** | (2006.01) |
| ***D06M 101/32*** | (2006.01) |

(52) U.S. Cl.
CPC ..... *D06C 27/00* (2013.01); *D03D 13/008* (2013.01); *D03D 15/217* (2021.01); *D03D 15/283* (2021.01); *D03D 15/47* (2021.01); *D03D 47/30* (2013.01); *D06C 15/02* (2013.01); *D06L 1/12* (2013.01); *D06L 4/13* (2017.01); *D06L 4/60* (2017.01); *D06M 10/00* (2013.01); *D06M 2101/06* (2013.01); *D06M 2101/32* (2013.01); *D10B 2201/02* (2013.01); *D10B 2331/04* (2013.01); *D10B 2401/04* (2013.01); *D10B 2505/08* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,151,322 | A * | 4/1979 | Rosenthal | D02G 3/443 442/310 |
| 6,989,035 | B2 * | 1/2006 | Scheper | D06M 13/192 427/393.2 |
| 2003/0027476 | A1 | 2/2003 | Vogt | |
| 2011/0275263 | A1 * | 11/2011 | Li | D03D 1/0041 442/141 |
| 2021/0079568 | A1 | 3/2021 | Garg | |

FOREIGN PATENT DOCUMENTS

| | | | |
|---|---|---|---|
| CN | 110872737 | A | 3/2020 |
| JP | H05171564 | A | 7/1993 |

* cited by examiner

*Primary Examiner* — Lynda Salvatore
(74) *Attorney, Agent, or Firm* — Carmel Patent Agency; Robert Ballarini

(57) ABSTRACT

A method for producing a combustion resistant upholstery fabric with a weight of approximately 180-210 g/m$^2$ includes:

- at least one preparation step of an intimate blend yarn with 65% by weight of polyester fibers and 35% by weight of cotton fibers,
- at least one weaving step with a 2/1 twill weave of the yarn thus prepared to obtain a fabric,
- at least one washing step of said fabric to obtain a bleached fabric,
- at least one step of pressing said bleached fabric, the pressing step involves inserting said bleached fabric inside at least one calender to obtain an upholstery fabric.

11 Claims, No Drawings

FABRIC AND METHOD FOR OBTAINING SAID FABRIC

FIELD OF THE TECHNIQUE

The present invention relates to a method for the production of an improved upholstery fabric, and in particular an improved upholstery fabric to be used for lining and/or lining elements made of soft material such as upholstery cushions.

The present invention therefore finds advantageous use in the technical sector of the production and marketing of accessories for furniture or the like and more particularly in the sector of the production and marketing of fabrics, in particular upholstery fabrics.

BACKGROUND OF THE INVENTION

It is known in the furniture manufacturing field to cover sofas, chairs and armchairs, with cushions made of soft material, such as polymeric foams (e.g. polyurethane) and feathers or other synthetic-based substitutes. It is also known that said cushions are lined with a fabric which has the function of keeping them in the required shape and preventing dispersion of the padding. This is particularly important in the case of padding made of feathers, and in this case it is necessary that the fabric has a sufficiently tight weave to prevent it from coming out.

In the technical sector it is also known the need for the padding or the cushion, after being crushed for example by the weight of a user, to be able to return to its initial position, swelling, thanks to the air passing through it.

For this purpose, it is known to determine how dense the weft is by measuring the permeability of the air, in particular the flow of air that transpires through the fabric at a pressure of 200 Pa, according to the UNI EN ISO 9237: 1997 standard.

It is also known that the materials generally used for making the padding, in particular in the case of synthetic materials, can be easily flammable. In order to improve the safety of users, there are various national and international standards that require that the fabric used for the lining is fireproof, ie non-flammable or that it is able to delay its combustion as much as possible.

In order to evaluate these characteristics and as a guarantee for the end user, various flammability tests are known, to be performed on the upholstery fabrics, to define the degree of flammability and, if they pass the tests, to define these fireproof fabrics.

For example, the test 15066 is known, called: "upholstered furniture: evaluation of flammability by cigarette", carried out according to the method BS5852-1: 1979/BS5852: 2006/EN 1021-1 valid in Italy and the test is also known California TB (Technical Bulletin) 117: 2013 SECTION 2 (referred to as "Barrier/Interliner Material" or known in jargon as the "California" test, as California was the first state to adopt this test) valid in the United States.

The above known tests allow to measure the reaction to fire (to combustion) of an upholstered piece of furniture (or other upholstered furniture component) and in particular the reaction to fire (or to a heat source) of its upholstery fabric. More specifically, the tests involve evaluating the reaction of the furniture (and in particular the reaction of its upholstery fabric) to a heat source (for example the ember of a lit cigarette) placed in proximity and/or in contact with the surface of the upholstery fabric that covers the piece of furniture to be evaluated. The above two tests allow to classify the flame resistance of the upholstery fabric of the tested furniture.

In order to limit its flammability, it is known to produce upholstery fabrics comprising flame retardant compounds, such as for example chemical salts, in particular brominated, or containing phosphorus. The treatment of cotton upholstery fabrics with such flame retardants is now widely used in the reference technical sector.

More in detail, brominated flame retardants (known in the technical sector with the acronym BFR) are compounds of organobromine capable of providing normally combustible materials (such as in particular the upholstery fabrics) with a flame retardant effect, ie the effect of increasing the exposure time of the fabric to the heat source and the temperature necessary to ignite the upholstery fabric. Among the chemical flame retardants known and currently on the market, BFRs represent the most widely used family of compounds. Such flame retardants are widely used in the production of everyday items with plastic or textile components, such as electronic products, clothing and furniture.

However, the upholstery fabrics equipped with the aforementioned flame retardants have proved to be not free from drawbacks in practice.

The main drawback lies in the fact that flame retardants made using chemical salts, in particular brominated, are toxic and have harmful effects for the human organism, especially for the human nervous system (they are neurotoxic compounds).

Therefore, in light of this toxicity, their use in everyday objects such as pillows and mattresses, in contact with which a user spends about eight hours every night, is less and less widespread and not recommended.

JPH05171564 describes a method for imparting a valuable appearance to a fabric comprising polyester fibers and cellulose-based fibers, and with a percentage by weight of polyester fibers ranging from 10% to 90%. The method involves first calendering the fabric and then soaping it.

CN 110872737 discloses a method of making a low shrinkage polyester-cotton fabric. In particular, the fabric is obtained by spinning together 40-50% by weight of cotton fibers, 20-30% by weight of common polyester fibers, 10-20% of low-melting polyester fibers, 5-10% of superfine polyester fibers, 5-10% double strength polyester fibers. Subsequently, the weaving, dyeing and finishing phase is carried out to obtain the finished product in fabric. In particular, the finishing phase involves immersion in the softener, a cooking phase to lower the moisture content, calendering, a shaping, heating and finally cooling phase.

CN109371705 describes a method for producing a tear resistant fabric. In particular, the fabric—which is obtained using a polyester-cotton yarn—is subjected to various treatments, and more in detail to a lamination treatment, alkaline washing, scouring, semi-sweeping, heat setting, stretching, calendering and coating, to obtain a tear resistant fabric.

OBJECTIVES OF THE INVENTION

The object of the invention is to propose a method for the production of a combustion-resistant upholstery fabric which solves, at least partially, the drawbacks of the aforementioned prior art.

Another object of the invention is to propose a method for the production of an upholstery fabric that can be used to cover furnishing elements, for example made of soft material, such as in particular cushions or the like.

Another object of the invention is to propose a method for the production of an upholstery fabric which is flame retardant, ie which guarantees flame resistance, or a delay in the development of the flame if in contact with a heat source, and in particular that satisfies the requirements of the tests of the sector, and above all of the test described in California TB (Technical Bulletin) 117: 13 section 2.

Another object of the invention is to propose an upholstery fabric that is soft or soft to the touch.

Another object of the invention is to propose an upholstery fabric which does not have flame retardant chemical salts and which does not require any treatment with flame retardant chemical salts.

Another object of the invention is to propose an upholstery fabric which does not have brominated flame retardants.

Another object of the invention is to propose an upholstery fabric which does not have phosphorus flame retardants.

Another object of the invention is to propose an upholstery fabric which effectively defines a container for the feathers of an element made of soft material, preventing them from escaping.

Another object of the invention is to propose an upholstery fabric which prevents the feathers from escaping from their seat.

Another object of the invention is to propose an upholstery fabric which has any desired coloring.

Another object of the invention is to propose an upholstery fabric which allows a reduced passage of air.

Another object of the invention is to propose a method for the production of an upholstery fabric which can be implemented in a safe, easy, rapid and low-cost manner.

Another object of the invention is to propose an upholstery fabric and a method for its production which are alternative and/or improvements with respect to traditional solutions.

Another object of the invention is to propose a method for the production of an upholstery fabric which can be implemented with rapid production cycles.

Another object of the invention is to propose a cushion or a multilayer cover which does not use flame retardant chemical salts and which at the same time is flame retardant, ie which guarantees resistance to flame, or a delay in the development of the flame if in contact with a source of heat, and in particular that satisfies the requirements of the tests in the sector, and above all of the test described in California TB (Technical Bulletin) 117: 13 section 2.

Another object of the invention is to propose a cushion or a multilayer cover which is safe to use Another object of the invention is to propose a cushion or a multilayer cover that can be made in a safe, quick, easy and low-cost manner.

SUMMARY OF THE INVENTION

All these objects, either alone or in any combination thereof, and others which will result from the following description are achieved, according to the invention, with a method for the production of an upholstery fabric and/or with a cover fabric and/or with a multilayer cover and/or with a cushion or other piece of furniture according to claim 1as set forth below.

DETAILED DESCRIPTION OF THE INVENTION AND OF SOME OF ITS PREFERRED EMBODIMENTS

The present invention is further clarified hereinafter in a preferred embodiment thereof reported for purely illustrative and non-limiting purposes.

The combustion-resistant upholstery fabric, advantageously obtainable with the method also object of the present invention, is preferably configured to be used to cover and/or line furnishing elements, preferably in soft or soft hand-made material, such as cushions that ad for example they are used in the production of furniture, and in particular of sofas and/or armchairs.

In particular, said furnishing elements, advantageously in soft hand material, can be made of polymeric foams, or more preferably they can be made of natural feathers, feathers and/or down or synthetic material, such as virgin polyester fibers or recycled.

Conveniently, the combustion-resistant upholstery fabric according to the invention can be preferably used to make a lining layer which is preferably internally directly in contact with the material that forms the piece of furniture to be lined and/or covered.

Conveniently, the combustion-resistant upholstery fabric according to the invention can preferably be used to make a lining layer which can be externally the visible one and/or can come into direct contact with the user of the furniture element Advantageously, the combustion-resistant upholstery fabric according to the invention can be preferably used to make a lining layer which can be externally covered by a further layer, for example in fabric, which can face towards the external environment, ie it can be the one configured to make contact with a user of the furniture.

The method for the production of an upholstery fabric resistant to combustion and with a weight of about 180-210 g/m$^2$, object of the present invention, comprises:

- at least one preparation step of an intimate blend yarn with 65% by weight of polyester fibers and 35% by weight of cotton fibers, the
- at least one phase of weaving with a twill weave 2/1 of said yarn thus prepared to thus obtain a fabric,
- at least one washing step of said fabric to obtain a bleached fabric;
- at least one step of pressing said bleached fabric, preferably by hot calendering; in particular, the pressing step involves inserting said bleached fabric inside at least one calender to obtain an upholstery fabric.

Preliminarily, as said, the method according to the invention provides at least one step for preparing a yarn, which comprises at least a percentage by weight of polyester of 65% and at least a percentage by weight of cotton of 35%.

More in detail, the aforesaid preparation step provides for the realization of the aforesaid yarn, by means of at least one mixing sub-step, in which polyester fibers and cotton fibers are mixed.

Preferably, the mixing step involves mixing together longitudinal fibers of cotton and polyester, to create a single yarn or a bundle of fibers, the complex of which is called, in technical jargon, "polycotton".

The preparation phase therefore advantageously provides for a spinning sub-phase in which said polyester fibers and/or said cotton fibers are spun together forming said yarn.

Conveniently, the yarn is composed of cotton fibers mixed in an intimate blend with polyester fibers.

Suitably, the yarn comprises about 65% by weight of polyester and about 35% by weight of cotton.

Suitably, the yarn comprises about 65% by weight of polyester fibers and about 35% by weight of cotton fibers. This ratio between polyester fibers and cotton fibers is optimal as it allows the fabric thus made to be resistant to combustion and in particular to comply with sector regulations, and more in detail to overcome, without the use of fireproofing chemicals, the so-called "California" test, ie the test described in California TB (Technical Bulletin) 117: 2013—section 2.

Advantageously, the yarn can be carded or combed yarn.

Conveniently, the polyester used, both for making the fabric according to the invention, and for making the element in soft material can be recycled.

The method therefore involves a weaving phase of the previously prepared yarn by means of a twill or 2/1 twill weave.

Advantageously, by weaving by twill weave is meant a weaving which allows to obtain a fabric in which the warp threads bind the wefts proceeding with a diagonal course.

Conveniently, the yarn is woven with a 2/1 twill weave, ie the weaving of which has diagonal lines, in which one face (called "right" or "technical face") has a different conformation from the other face (called "reverse" or "technical rear"). Conveniently, in fact, from one side of the fabric the warp threads pass twice over the weft and once under it, while the opposite occurs on the other side. In particular, the twill weave designated with the fraction "2/1" indicates that two harnesses are raised (and therefore there are two crossed threads) while only one harness is lowered when a weft thread is inserted.

The weaving with 2/1 twill weave is particularly advantageous, indeed optimal, as the resulting weave is particularly dense and the holes between the threads allow to avoid the leakage of the material to be covered or filling (in particular in the case of feathers or other padding).

Advantageously, the yarn used for weaving can have a thickness of 30 NE (Number English) in the warp and 20 NE (Number English) in the weft.

Advantageously, the fabric obtained following the weaving step can be provided with an open or closed selvedge.

Preferably, the weaving step is carried out with an air-jet loom, i.e. a loom without shuttle which uses a jet air current to pull the weft thread through the shed. Conveniently, the operating principle envisages using air as a means for inserting the weft into the warp. More in detail, a compressed air flow is used to pull a weft thread by means of a frictional traction force generated between the thread itself and the air flow. For this purpose, the jet/air flow generated by the air-jet frame is used to achieve the purpose.

Preferably, said at least one weaving step is configured to obtain with said yarn a fabric with a twill weave 2/1 and having a weight of about 180-210 g/m$^2$.

Advantageously, the raw fabric (i.e. the fabric obtained following the weaving step) can have a weight greater than about 200 g/m$^2$, preferably about 205 g/m$^2$.

Advantageously, the raw fabric has a width, transversely with respect to its prevailing direction of development, of about 170 cm or about 330 cm.

Preferably, following the preparation phase, the method provides for a sewing phase, to sew the various pieces of fabric (ie technical term to identify portions of the fabric) to thus produce reels of fabric, preferably with a length of between 5 and 10 km.

The method according to the invention further provides for at least one washing step of said fabric to obtain a bleached fabric.

In accordance with a preferential embodiment of the present invention, said washing step comprises at least a first sub-step of heat treatment by washing said fabric with caustic soda.

Advantageously, moreover, said washing step comprises at least a second heat treatment sub-step by washing said fabric with sodium hypochlorite and/or with hydrogen peroxide and/or with optical brighteners.

Conveniently, the first washing sub-phase using caustic soda is called the purging sub-phase and the second washing sub-phase using sodium hypochlorite and/or hydrogen peroxide and/or optical brighteners is called the bleaching sub-phase.

Following the washing phase, the cotton used in the yarn obtains the desired white color.

Advantageously, the cotton used in the yarn can have limited contamination from external fibers and, in particular, the cotton used can be known as contamination-controlled (CC).

The method preferably comprises, following said washing step, at least one drying step. Preferably, in said drying step said bleached fabric is dried by irradiation at a temperature higher than 150° C. and preferably between 150° C. and 200° C.

More in detail, preferably, the drying step is carried out in a stenter equipped internally with holding means, for example grippers or the like, capable of mechanically retaining the fabric in a taut configuration during the drying step itself.

The method according to the invention further comprises at least one step of pressing said bleached fabric, preferably by hot calendering. In particular, the pressing step involves inserting said bleached fabric inside at least one calender to obtain an upholstery fabric. Advantageously, following the pressing step, the upholstery fabric can have a weight lower than about 200 g/m$^2$, preferably about 188 g/m$^2$.

The upholstery fabric obtained following said pressing step has a lower weight than the weight that said fabric has before being subjected to said pressing step.

Conveniently, the upholstery fabric according to the invention has a weight of about 180-210 g/m$^2$ and this is particularly advantageous, indeed optimal, since on the one hand it allows to avoid the leakage of the material to be covered or filling (in particularly in the case of feathers or other padding) and at the same time, on the other hand, avoids having a fabric that is too rigid and that generates an unwanted noise following its contact, thus resulting not suitable for the upholstery (in particular for the upholstery a cushion of an armchair, sofa or other soft or upholstered piece of furniture).

Advantageously, said pressing step provides for the passage of said bleached fabric between heated and counter-rotating rollers of said calender, in which said rollers are heated to a temperature higher than 150° C., and more preferably equal to about 190° C., at a higher pressure of about 200 kg/cm$^2$, and preferably at a pressure of about 295 kg/cm$^2$.

The pressing step has the advantageous purpose of reducing the thickness and/or reducing the size of the holes present in the weave of the fabric.

Furthermore, the hot calendering step is particularly advantageous as it allows the light dissolution of the polyesterfibers of the fabric yarn, thus preventing the internal element to be lined (for example the feathers) from coming out outside the lining made with said tissue.

Preferably, the upholstery fabric obtained following the pressing step has a width, transversely with respect to the main development direction, of between 140 cm and 180 cm and preferably of about 160 cm.

Advantageously, said upholstery fabric obtained following said pressing step is provided with air permeability which allows an air flow passage of less than 55 mm/s at a pressure of 200 Pa.

Preferably, said upholstery fabric obtained following said pressing step is provided with air permeability which allows an air flow passage of about 40 mm/s at a pressure of 200 Pa.

The method according to the invention does not provide for the application on the fabric of any flame retardant chemical salt, and in particular the fabric is not treated with brominated or phosphorus flame retardant materials.

The present invention also relates to an upholstery fabric which can be advantageously obtained by means of the method described up to now.

The combustion-resistant upholstery fabric according to the invention comprises a calendered fabric, preferably hot, and provided with at least a percentage by weight of polyester and at least a percentage by weight of cotton, in which the percentage by weight of polyester is greater than percentage by weight of cotton. Preferably, the combustion-resistant upholstery fabric according to the invention comprises a calendered fabric, preferably hot, and obtained with an intimate blend of polyester and cotton fibers, preferably in which the percentage by weight of the polyester is about 65% while the percentage by weight of cotton fibers is about 35%. Preferably, the cover fabric is woven with a 2/1 twill weave. Preferably, the upholstery fabric according to the invention has a weight lower than about 200 g/m$^2$, preferably about 188 g/m$^2$. Conveniently, the upholstery fabric according to the invention is completely free of flame retardant chemical salts.

Advantageously, the upholstery fabric can have a warp with an average of about 49 threads per cm.

Advantageously, the upholstery fabric can have a weft with an average of about 30 strokes per cm.

Advantageously, the combustion resistant upholstery fabric according to the invention is not treated with flame retardant materials, and in particular it is not treated with brominated flame retardant materials (measured according to the UNI EN ISO 17881-1: 2016 standard) such as:

| | |
|---|---|
| 2-Monobromobiphenyl (PBB1) | CAS No 2052-07-5 |
| 2,5-Dibromobiphenyl (PBB9) | CAS No 57422-14-2 |
| 2,2',5-Tribromobiphenyl (PBB18) | CAS No 59080-34-1 |
| 2,2',4,5'-Tetrabromobiphenyl (PBB49) | CAS No 60044-24-8 |
| Pentabbromo-1,1'-biphenyl (PBB103) | CAS No 14910-04-4 |
| 2,2',3,3',4,4',5,5'-Hexabromobiphenyl (PBB153) | CAS No. 59080-40-9 |
| Heptabromo-1,1'biphenyl (PBB180) | CAS No. 88700-06-05 |
| 2,2',3,3',4,4',5,5'-Octabromobiphenyl | CAS No. 67889-00-3 |
| 2,2',3,3',4,4',5,5',6-Nonabromobiphenyl | CAS No. 69278-62-2 |
| Decabromobiphenyl PBB209 | CAS No. 13654-09-6 |
| Pentabromodiphenylether BDE99 | CAS No. 32534-81-9 |
| Decabromodiphenylether BDE209 | CAS No. 1163-19-5 |
| Hexabromocyclododecane HBCDD | CAS No. 3194-55-6 |
| 2,2',4,4'-Tetrabromodiphenylether BDE47 | CAS No. 5436-43-1 |
| 2,2',3,4,4',5,6'-Hexabromodiphenylether BDE154 | CAS No. 207122-15-4 |
| 2,2'3,4,4',5',6-Heptabromodiphenylether BDE183 | CAS No. 207122-16-5 |
| 2,2',3,4,4',5,5',6-Octabromodiphenylether BDE203 | CAS No. 337513-72-1 |

or phosphorus flame retardants (measured according to UNI EN ISO 17881-2: 2016), such as:

| | |
|---|---|
| TRIS Tris (2,3-dibromopropyl) phosphate | CAS 126-72-7 |
| TCEP Tris (2-chloroethyl) phosphate | CAS 115-96-8 |

-continued

| | |
|---|---|
| TDCPP Tris (1,3-dichloro-2propyl) phosphate | CAS 13674-87-8 |
| TCPP Tris (1-chloro-2-propyl) phosphate | CAS 13674-84-5 |
| TBBPA Tetrabromobisphenol A | CAS 79-94-7 |

In order to better evaluate the properties of the fabric according to the invention, the same is been subjected to torsion tests, with the following results:

| Test carried out | measurement unit | obtained value |
|---|---|---|
| Average | rpm | 771 ± 14 |
| Average | rpm | 19.6 |
| Direction of twist | | Z |
| Variation coefficient | % | 3.20 |
| Torsion coefficient | alpha | 108 |

| Test carried out | measurement unit | obtained value |
|---|---|---|
| Average torsion | rpm | 621 ± 13 |
| Average torsion | rpm | 15.8 |
| Direction of torsion | | Z |
| Variation coefficient | % | 3.80 |
| Torsion coefficient | alpha | 106 |

| | |
|---|---|
| Test method | ISO 17202: 2002 |
| Ambient and test in normal atmosphere | (20 ± 2) ° C. · (65 ± 4)% RH |
| Test equipment | Twist meter |
| Conditions of the wire | white |
| Pretension applied | 10 cN per warp, 15 (cN per weft) |
| Length test useful | (500 ± 1) mm |
| Elimination of non-fibrous materials | no |
| Number of test tubes analyzed | 15 per direction |

The subject of the present invention also forms a cushion or other piece of furniture, preferably for furniture such as sofas and/or armchairs, which is covered or lined with a combustion resistant upholstery fabric as described above and/or obtainable with the method according to the invention as described above. Conveniently, said cushion comprises an internal element made of soft material (which thus defines the padding material) which is externally covered by a cover which is made entirely, or at least in part, with a combustion-resistant cover fabric as described above and/or obtainable with the method according to the invention as described above.

Conveniently, the internal element made of soft material (which thus defines the padding material) of the cushion can comprise polymeric foams and/or feathers, natural or synthetic feathers and/or duvets.

Advantageously, an internal element made of soft material (such as for example non-flame retardant polyurethane foam with a density of 28 kg/m$^3$) lined with a combustion resistant fabric according to the invention was subjected to a flame reaction test 15066 PADDED FURNITURE: OF FLAMMABILITY BY CIGARETTE according to the method described in California TB (Technical Bulletin) 117: 2013—section 2.

Type of Fabric: Material Barrier/Interliner

| Number Tube | 1 | 2 | 3 |
|---|---|---|---|
| Total combustion of the cigarette (YES/NO) | YES | YES | YES |
| Duration of progressive combustion (without flame) from the application of the source (min) | 44 | 43 | 44 |
| Size of the damage to the "Standard Type II" coating (mm) | 41 | 44 | 45 |
| Presence of combustion WITH flame (YES/NO) | NO | NO | NO |
| TEST RESULT (PASS/FAIL) | PASS | PASS | PASS |

Conditioning of the sample and ignition source: 24 h 21±3° C., <55% relative humidity with ambient temperature and relative humidity measured during the test: 19° C., 44% relative humidity.

The fabric improved according to the invention and/or obtained with the method according to the invention is particularly advantageous in that it is resistant to combustion, and in particular complies with the regulations of the sector, and in more detail passes the test described in California TB (Technical Bulletin) 117: 2013—section 2, and this is achieved without the use of fire retardant chemicals.

The present invention also relates to a multilayer lining and/or containment lining, capable of containing and/or lining a padding or filling material inside it. The multilayer lining can be made at least partially with a combustion-resistant upholstery fabric as described above and/or obtainable with the method according to the invention described above.

Conveniently, the multilayer lining can comprise/be for example a lining or the like.

Advantageously, the multilayer lining can be made by coupling the upholstery fabric according to the invention with at least a second material, known per se, and not described in detail below.

All the technical characteristics described with reference to the method and/or to the fabric must also be understood as described also with reference to the cushion and/or the multilayer covering and/or containment.

Unlike the methods described in JPH05171564, CN110872737 and CN109371705, the method according to the invention provides for the use of an intimate blend yarn formed by 65% by weight of polyester fibers and 35% by weight of cotton fibers, provides for carrying out a weaving phase with 2/1 twill weave and also the upholstery fabric has a weight of about 180-210 g/m$^2$. This is particularly advantageous, indeed optimal, as it allows to obtain a fabric that is particularly suitable to be used for upholstery, in particular the weight of about 180-210 g/m2 combined with the 2/1 twill weave allow to avoid the leakage of the material to be covered or filled (in particular in the case of feathers or other stuffing), and at the same time the use of an intimate blend yarn with polyester fibers for 65% by weight and with fibers of, and in particular makes it compliant with sector regulations, and in more detail it allows to pass combustion the test described in California TB (Technical Bulletin) 117: 2013—section 2.

The present invention has been illustrated in a preferred embodiment thereof, but it is understood that executive variations may be applied to it in practice, without other than departing from the scope of protection of the present patent for industrial invention.

The invention claimed is:

1. Method for producing a combustion resistant upholstery fabric with a weight of approximately 180-210 g/m$^2$, said method comprising:

at least one preparation step of an intimate blend yarn with 65% by weight of polyester fibers and 35% by weight of cotton fibers, at least one weaving step with a 2/1 twill weave of said yarn thus prepared to obtain a fabric, at least one washing step of said fabric to obtain a bleached fabric, at least one step of pressing said bleached fabric, said at least one pressing step involves inserting said bleached fabric inside at least one calender to obtain an upholstery fabric, wherein:

said at least one step of pressing said bleached fabric comprises heated calendaring;

said at least one pressing step further comprises passing said bleached fabric between heated and counter-rotating rollers of said calender, in which said rollers are heated to a temperature higher than 150° C., at a pressure higher than 200 kg/cm$^2$;

the method does not provide for the application of any flame-retardant chemical salt to the upholstery fabric;

the combustion resistant upholstery fabric according to the invention is not treated with flame retardant materials;

said upholstery fabric obtained following said at least one pressing step is equipped with air permeability which allows an air flow passage of less than 55 mm/s, at a pressure of 200 Pa.

2. The method according to claim 1, wherein the upholstery fabric obtained following said at least one pressing step has a lower weight than the weight of said upholstery fabric before being subjected to said at least one pressing step.

3. The method according to claim 1, wherein the at least one weaving step is carried out with an air jet loom.

4. The method according to claim 1, wherein the upholstery fabric obtained following said at least one weaving step, and before said pressing step, has a weight greater than 200 g/m$^2$.

5. The method according to claim 1, wherein, following said at least one pressing step, the obtained upholstery fabric has a weight of less than 200 g/m$^2$.

6. The method according to claim 1, wherein said at least one washing step comprises at least a first sub-step of heat treatment by washing said upholstery fabric with caustic soda.

7. The method according to claim 6, wherein said at least one washing step comprises at least a second heat treatment sub-step by washing said upholstery fabric with sodium hypochlorite and/or with hydrogen peroxide and/or with optical brighteners.

8. The method according to claim 1, wherein said at least one preparation step provides:

at least one blending sub-phase, in which polyester fibers and cotton fibers are mixed;

a spinning sub-phase, in which said polyester fibers and said cotton fibers are spun together thus forming a yarn.

9. The method according to claim 1, further comprising, following said at least one washing step, at least one drying step.

10. The method according to claim 9, wherein in said at least one drying step said bleached fabric is dried by irradiation at a temperature between 150° C. and 200° C.

11. The method according to claim 9, wherein in said at least one drying step a stenter is used internally equipped with means suitable for mechanically retaining the fabric in a taut configuration during the at least one drying step.

* * * * *